US008115406B2

(12) United States Patent
Wang et al.

(10) Patent No.: US 8,115,406 B2
(45) Date of Patent: Feb. 14, 2012

(54) FLUORESCENT LAMP DRIVER CIRCUIT

(75) Inventors: Chen-Hsung Wang, Sinjhuang (TW); Shu-Ming Chang, Sinjhuang (JP)

(73) Assignee: Niko Semiconductor Co., Ltd., Taipei (TW)

( * ) Notice: Subject to any disclaimer, the term of this patent is extended or adjusted under 35 U.S.C. 154(b) by 703 days.

(21) Appl. No.: 12/232,125

(22) Filed: Sep. 11, 2008

(65) Prior Publication Data

US 2009/0267536 A1 Oct. 29, 2009

(30) Foreign Application Priority Data

Apr. 23, 2008 (TW) ..... 97114810 A

(51) Int. Cl.
*H05B 41/24* (2006.01)

(52) U.S. Cl. ..... 315/279; 315/209 R; 315/219; 315/246; 315/291

(58) Field of Classification Search ..... 315/194, 315/195, 209 R, 224, 219, 246, 247, 274, 315/278, 291–308, 279
See application file for complete search history.

(56) References Cited

U.S. PATENT DOCUMENTS 6,674,389 B2 * 1/2004 Bult ..... 341/159
7,291,991 B2 11/2007 Chen
7,598,677 B2 * 10/2009 Stack ..... 315/127

FOREIGN PATENT DOCUMENTS

WO WO 2008/007925 * 1/2008

* cited by examiner

*Primary Examiner* — Jacob Y Choi
*Assistant Examiner* — Anthony Arpin
(74) *Attorney, Agent, or Firm* — Rosenberg, Klein & Lee

(57) ABSTRACT

A fluorescent lamp driver circuit is provided. The fluorescent lamp driver circuit uses reversed current detecting signal to achieve feedback control and circuit protection so as to simplify the driver circuit and reduces the number of the required electronic components. The driver circuit needs a single control unit to control the whole circuit, which not only reduces cost, but also simplifies circuit design.

21 Claims, 7 Drawing Sheets

FLUORESCENT LAMP DRIVER CIRCUIT

BACKGROUND OF THE INVENTION

1. Field of the Invention

The present invention relates to a fluorescent lamp driver circuit, and more particularly to a multi-lamp cold cathode fluorescent lamp (CCFL) driver circuit.

2. Description of Related Art

In a backlight device of a liquid crystal display (LCD), a high-frequency sine wave AC power supply is usually adopted for supplying electric power to drive a cold cathode fluorescent lamp (CCFL) to emit light. Therefore, a DC/AC inverter circuit is demanded for converting energy. The typical CCFL driver circuit usually has a resonance module to convert a DC voltage into an AC voltage for driving the CCFL to emit light. Voltage and current detect circuits are usually used for detecting a driving voltage and a driving current of the CCFL, respectively. A pulse width modulation (PWM) controller receives a voltage detection signal and a current detection signal for stabilizing the illumination of the CCFL and for circuit protection.

Attending with the development of large-scale LCD panels, the number of CCFLs in the backlight device needed to be driven is increased accordingly. The traditional circuit design with single PWM controller and single resonance module to drive single lamp may incur complicated circuits and high costs of such backlight device. To reduce the cost, U.S. Pat. No. 7,291,991 has disclosed a multi-lamp driver circuit to reduce the number of components in the circuit and simplify the circuit design.

With reference to FIG. 1 for a circuit diagram of a multi-lamp driver circuit in accordance with a U.S. patent, the multi-lamp driver circuit includes a PWM controller 10, a resonance module 20, a multi-lamp module including a plurality of lamps L1~L4, and a switch module 40. The switch module 40 is connected to an input voltage source Vin and is used to control the energy transmitted to the resonance module 20 according to control signals of the PWM controller 10. The resonance module 20 includes two transformers T1, T2 and a plurality of transistor switches. The lamps L1, L2 are connected in series with a secondary side of the transformer T1, and the lamps L3, L4 are connected in series with a secondary side of the transformer T2. Current detectors 32, 34 are serially connected to the lamps L1, L2 and the lamps L3, L4 respectively for detecting a lamp current passing through the lamps L1, L2 and a lamp current passing through the lamps L3, L4 to generate current detection signals IFB1, IFB2. Voltage detectors 36, 38 are connected in parallel with the lamps L1, L2 and the lamps L3, L4 respectively for detecting lamp voltages of the lamps L1, L2 and the lamps L3, L4 to generate voltage detection signals VFB1, VFB2. The PWM controller 10 receives the current detection signals IFB1, IFB2 and the voltage detection signals VFB1, VFB2 for performing feedback control to control the electric power transmitted by the switch module 40 so as to stabilize the light emission of the lamps and to protect the circuit under the abnormal conditions.

In the aforementioned circuit, one resonance module, one current detector, and one voltage detector are used for driving two lamps simultaneously, and one PWM controller is used for controlling the operation of four lamps. Compared with the conventional circuit, the multi-lamp driver circuit has reduced the number of pins of the PWM controller and the number of electronic components, and also simplified the circuit design. However, it is still an important subject for the CCFL driver circuit research to further reduce the number of pins of the PWM controller and the number of electronic components, and to simplify the circuit design.

SUMMARY OF THE INVENTION

It is an object of the present invention to further reduce the number of pins and the number of required electronic components of a multi-lamp driver circuit, so as to lower the cost of the circuit and simplify the circuit layout. The present invention provides a fluorescent lamp driver circuit comprising a switch module, a resonance module, a first fluorescent lamp module, a second fluorescent lamp module, a detection unit, a selection unit, a protection unit, and a control unit. The switch module is coupled to a DC input voltage and controls the magnitude of an output electric power according to a plurality of control signals. The resonance module is coupled to the switch module for converting the output electric power into a first AC signal and a second AC signal, wherein the first AC signal and the second AC signal are almost in opposite phases. In other words, the phase difference between the first AC signal and the second AC signal falls within a predetermined range from 180 degrees. The first fluorescent lamp module is coupled to the resonance module for receiving the first AC signal, and the second fluorescent lamp module is coupled to the resonance module for receiving the second AC signal. The detection unit includes a first detecting portion and a second detecting portion. One end of the first detecting portion and one end of the second detecting portion are coupled with a common ground. The other end of the first detecting portion is serially connected to the first fluorescent lamp module for generating a first detection signal, and the other end of the second detecting portion is serially connected to the second fluorescent lamp module for generating a second detection signal. The selection unit receives the first detection signal and the second detection signal and outputs a select signal. The protection unit receives the first detection signal and the second detection signal and outputs a protection feedback signal. The control unit is coupled to the selection unit and the protection unit, and generates the plurality of control signals according to the select signal for controlling the switching of the switch module. The control unit stops the switching of the switch module if the level of the protection feedback signal is higher than a predetermined value.

The present invention further provides a fluorescent lamp driver circuit comprising a switch module, a resonance module, a first fluorescent lamp module, a second fluorescent lamp module, a detection unit, a selection unit, a protection unit, and a control unit. The switch module is coupled to a DC input voltage, and controls the magnitude of an output electric power according to a plurality of control signals. The resonance module is coupled to the switch module for converting the output electric power into a first AC signal and a second AC signal, wherein the phase difference between the first AC signal and the second AC signal falls within a predetermined range from 180 degrees. The first fluorescent lamp module is coupled to the resonance module for receiving the first AC signal, and the second fluorescent lamp module is coupled to the resonance module for receiving the second AC signal. The detection unit includes a first detecting portion and a second detecting portion. One end of the first detecting portion and one end of the second detecting portion are coupled to a common ground. The other end of the first detecting portion is serially connected to the first fluorescent lamp module for generating a first detection signal. The other end of the second detecting portion is serially connected to the second fluorescent lamp module for generating a second detection signal.

The selection unit is coupled to the detection unit for receiving the first detection signal and the second detection signal, and outputting a select signal. The protection unit is coupled to the selection unit and the detection unit, for determining whether to transfer the select signal into a protection state or not according to the first detection signal and the second detection signal. The control unit is coupled to the selection unit and generates the plurality of control signals for controlling the switching of the switch module according to the select signal, and stops the switching of the switch module after the select signal transferred into the protection state is detected.

The present invention provides another fluorescent lamp driver circuit, comprising a switch module, a resonance module, a first fluorescent lamp module, a second fluorescent lamp module, a detection unit, a protection unit, and a control unit. The switch module is coupled to a DC input voltage, and controls the magnitude of an output electric power according to a plurality of control signals. The resonance module includes a primary side and a secondary side, and the primary side is coupled to the switch module for converting the output electric power into an AC signal and outputting the AC signal from the secondary side. The first fluorescent lamp module is coupled to the secondary side of the resonance module, and the second fluorescent lamp module is coupled to the secondary side of the resonance module. The detection unit includes a first detecting portion and a second detecting portion. One end of the first detecting portion and one end of the second detecting portion are coupled to a common ground. The other end of the first detecting portion is serially connected to the first fluorescent lamp module for generating a first detection signal. The other end of the second detecting portion is serially connected to the second fluorescent lamp module for generating a second detection signal. The phase difference between the first detection signal and the second detection signal falls within a predetermined range from 180 degrees. The protection unit receives the first detection signal and the second detection signal, and outputs a protection feedback signal. The control unit is coupled to the protection unit and outputs the plurality of control signals when the protection feedback signal is in a first state. The control unit stops the switching of the switch module when the protection feedback signal is in a second state.

In summation of the description above, the fluorescent lamp driver circuit provided in the present invention can achieve the object of feedback control of multi-lamp and circuit protection by using the detection signal selected by the selection unit, and even adjust and control the level of the output detection signal according to the protection feedback signal to achieve the object of using a single feedback signal to provide the functions of the feedback control and circuit protection. The present invention can also simplify the circuit design and reduce the number of electronic components significantly.

The above and other objects, features and advantages of the present invention will become apparent from the following detailed description taken with the accompanying drawing.

DETAILED DESCRIPTION OF PREFERRED EMBODIMENTS

Figure 1:
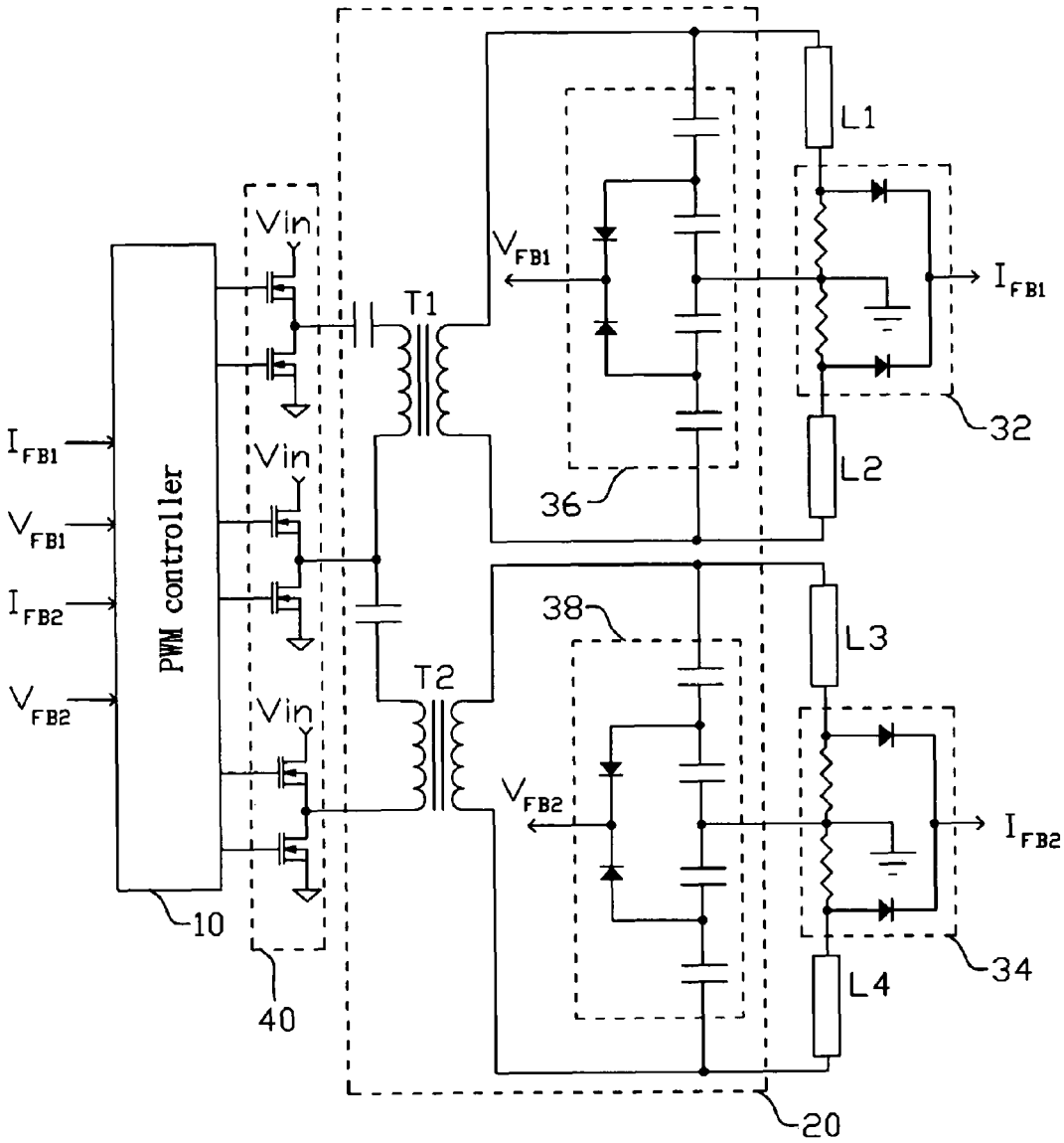
FIG. 1 PRIOR ART
FIG. 1 is a circuit diagram of a conventional multi-lamp driver circuit.
Figure 2:
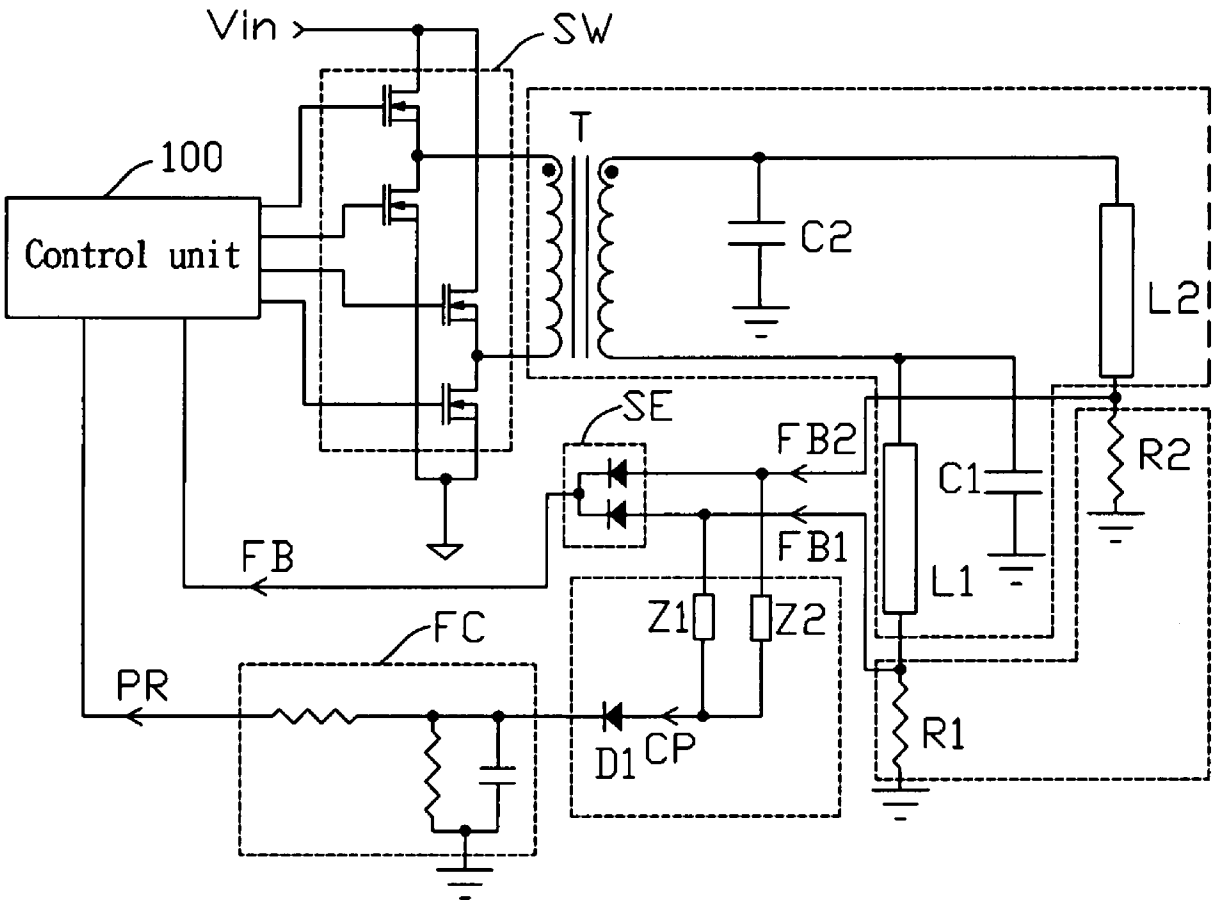
FIG. 2 is a circuit diagram of a multi-lamp driver circuit in accordance with a first preferred embodiment of the present invention.

With reference to FIG. 2 for a circuit diagram of a multi-lamp driver circuit in accordance with a first preferred embodiment of the present invention, the multi-lamp driver circuit comprises a switch module SW, a resonance module, a first fluorescent lamp module L1, a second fluorescent lamp module L2, a detection unit, a protection unit, and a control unit 100. The switch module SW is coupled to a DC input voltage Vin and is switched according to a control signal from the control unit 100 so as to control the magnitude of the output electric power. The switch module SW of this embodiment has a full-bridge architecture, but in practical, a half-bridge architecture or a push-pull architecture can be adopted in the switch module SW as well. The resonance module comprises resonant capacitors C1, C2 and a transformer T with a primary side and a secondary side. The primary side of the transformer T is coupled to the switch module SW, and the secondary side of the transformer T is coupled to the resonant capacitors C1, C2 for receiving the output electric power transmitted from the switch module SW and converting the output electric power into an AC signal outputted from the secondary side. The first fluorescent lamp module L1 is coupled to one end of a secondary side of the resonance module, and the second fluorescent lamp module L2 is coupled to the other end of the secondary side of the resonance module. Both the first fluorescent lamp module L1 and the second fluorescent lamp module L2 receives the AC signal outputted from the secondary side of the resonance module to emit light. The detection unit includes a first detecting portion and a second detecting portion, wherein the first detecting portion includes a first detecting resistor R1 and the second detecting portion includes a second detecting resistor R2. The first detecting portion and the first fluorescent lamp module L1 are serially connected to the secondary side of the resonance module, and the second detecting portion and the second fluorescent lamp module L2 are serially connected to the secondary side of the resonance module as well. One end of the first detecting portion and one end of the second detecting portion are coupled to a common ground, and the other ends of the first detecting portion and the second detecting portion are serially connected to the first fluorescent lamp module L1 and the second fluorescent lamp module L2 for generating a first detection signal FB1 and a second detection signal FB2 respectively. It is noted that the currents passing through the first fluorescent lamp module L1 and the second fluorescent lamp module L2 are in opposite directions. Thus, the first detection signal FB1 and the second detection signal FB2 are almost in opposite phase. In other words, the phase difference of the first detection signal FB1 and the second detection signal FB2 falls within a range from 180 degrees. Since the impedance of the fluorescent lamp modules is not perfectly matched in practice, the phase difference between the first detection signal FB1 and the second detection signal FB2 would not be exactly equal to 180 degrees. The deviation of the phase difference from 180 degrees is dependent to the impedance difference. However, the phase difference will remain in the certain range from 180 degrees.

The selection unit SE receives the first detection signal FB1 and the second detection signal FB2, and selectively output one of the two detection signals FB1 and FB2 to form a select signal FB according to the timing of the two detection signals FB1 and FB2. In this embodiment, the selection unit SE includes two diodes with positive terminals thereof coupled to a first detecting resistor R1 and a second detecting resistor R2 respectively, and negative terminals thereof coupled with each other, such that the selection unit SE would selectively output the first detection signal FB1 and the second detection signal FB2 to form a full-wave select signal FB. The protection unit is coupled to the detection unit for receiving the first detection signal FB1 and the second detection signal FB2, and outputting a protection feedback signal PR. The protection unit includes a compensating portion and a filter portion FC, wherein the compensating portion includes impedance compensation components Z1, Z2, such as resistors, capacitors, or any other components having impedance. The impedance compensation components Z1 and Z2 are coupled to the first detecting resistor R1 and the second detecting resistor R2 of the detection unit respectively so as to have the first detection signal FB1 and the second detection signal FB2 compensated with each other to generate a compensation signal CP. Under a normal operation condition, the first detection signal FB1 and the second detection signal FB2 are substantially opposite in phase and have similar magnitude, and the compensation signal CP outputted from the compensating portion would substantially approach zero potential. Meanwhile, the protection feedback signal PR is in a first state representing the normal operation. If there is any open circuit, short circuit, or other abnormality happened in the first fluorescent lamp module L1 or the second fluorescent lamp module L2, impedance mismatch between the first fluorescent lamp module L1 and the second fluorescent lamp module L2 will become more serious than that under the normal operation condition. Thus, the magnitude difference of the first detection signal FB1 and the second detection signal FB2 would be increased and the phase difference there between would be deviated away from the 180 degrees more seriously, and the compensation signal CP with larger amplitude would be resulted. The compensation signal CP is then transmitted to the filter portion FC through the rectifier diode D1. After filtering out the high frequency portion, the protection feedback signal PR is resulted. It is noted that the level of the protection feedback signal PR would be increased in contrast with that under the normal operation condition, and thus the protection feedback signal PR is in a second state representing the abnormality.

The control unit 100 receives the select signal FB and the protection feedback signal PR and performs feedback control according to the select signal FB to stabilize the current passing through the first fluorescent lamp module L1 and the second fluorescent lamp module L2 to generate steady illumination. If the level of the protection feedback signal PR is higher than a predetermined value, the protection feedback signal PR is determined to be in the second state indicating abnormal circuit, and the control unit 100 will stop the switching of the switch module SW. Meanwhile, the switch module SW stops outputting energy to the resonance module, and the fluorescent lamp driver circuit enters a protection mode. To prevent the temporary voltage rise of the protection feedback signal PR caused by a sudden disturbance happened in the first fluorescent lamp module L1, the second fluorescent lamp module L2, and the system circuit or other factors (such as system booting) from resulting in misjudgments because the circuit is not damaged or showing any abnormality under such condition, a predetermined time can be set, such that unless the level of the protection feedback signal PR is higher than the predetermined value and remains the predetermine time, the control unit 100 would not stop the switching of the switch module.

Figure 3:
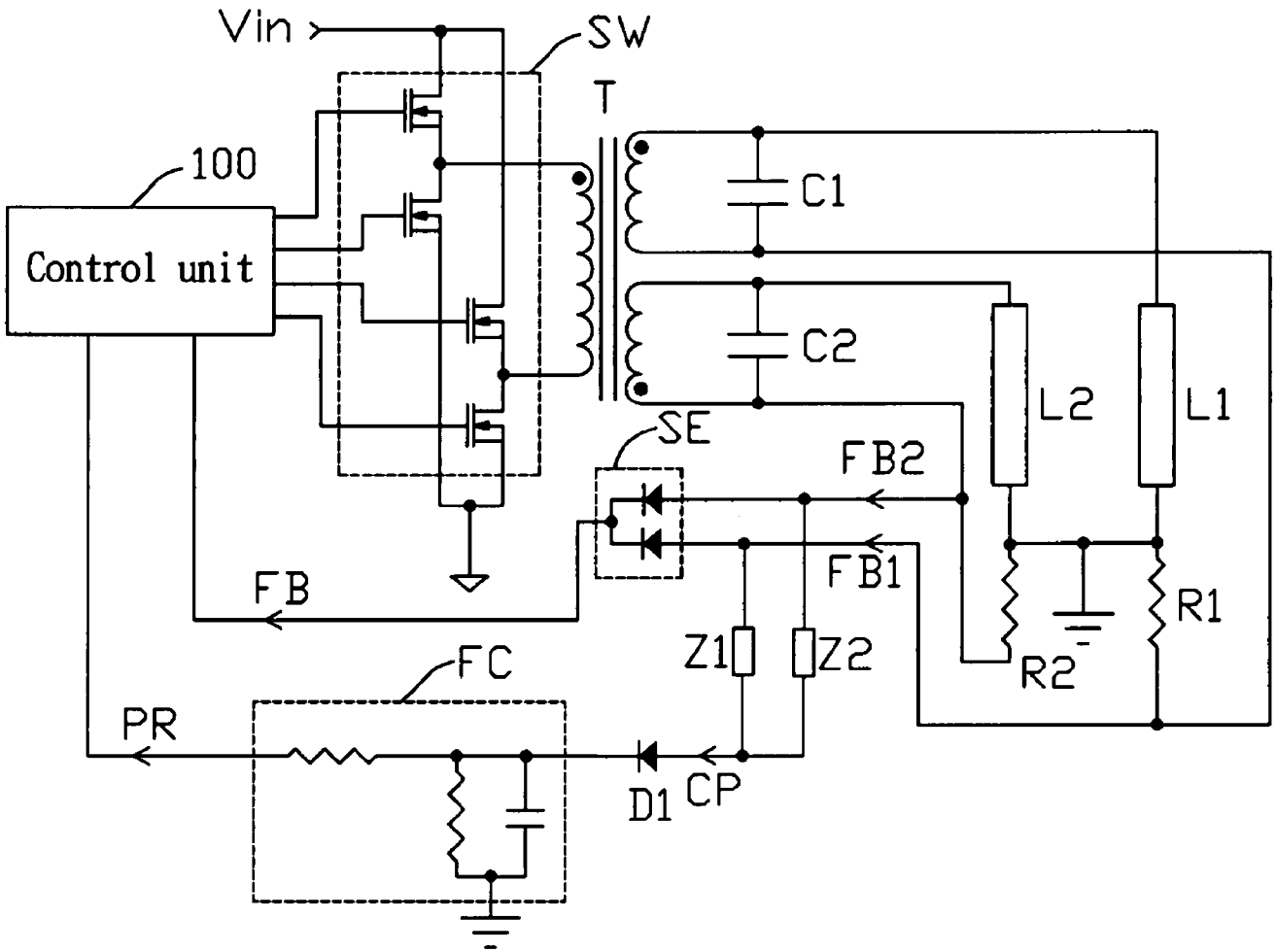
FIG. 3 is a circuit diagram of a multi-lamp driver circuit in accordance with a second preferred embodiment of the present invention.

With reference to FIG. 3 for a circuit diagram of a multi-lamp driver circuit in accordance with a second preferred embodiment of the present invention, the difference of this embodiment from the first preferred embodiment is that there are two windings disposed at the secondary side of the transformer T of the resonance module in this embodiment coupled to the resonant capacitors C1, C2 respectively for converting electric power into a first AC signal and a second AC signal. The polarities of the two windings are opposite. Thus, the phases of the first and the second AC signals are opposite. The first fluorescent lamp module L1 is coupled to one of the two secondary side windings of the transformer T for receiving the first AC signal, and the second fluorescent lamp module L2 is coupled to the other secondary side winding of the transformer T for receiving the second AC signal. The detection unit includes a first detecting resistor R1 and a second detecting resistor R2, and one end of the first detecting resistor R1 and one end of the second detecting resistor R2 are coupled to a common ground. The other end of the first detecting resistor R1 is serially connected to the first fluorescent lamp module L1 for generating the first detection signal FB1, and the other end of the second detecting resistor R1 is serially connected to the second fluorescent lamp module L2 for generating the second detection signal FB2. Since the phases of the first AC signal and the second AC signal are opposite, the level of the protection feedback signal PR outputted by protection unit according to the first detection signal FB1 and the second detection signal FB2 approaches zero potential under normal operation condition. If any abnormality occurs, the impedance mismatch of the first fluorescent lamp module L1 and the second fluorescent lamp module L2 becomes more serious to have the magnitude difference of the first detection signal FB1 and the second detection signal FB2 would be increased and/or the phase difference there between would be deviated away from the 180 degrees more seriously, and thus causing a level rising of the protection feedback signal PR. Thereby, if the level of the protection feedback signal PR is higher than a predetermined value, the control unit 100 will stop the switching of the switch module SW. As a preferred embodiment, in order to prevent misjudgments, if the level of the protection feedback signal PR is higher than the predetermined value and also remained at such condition after a predetermined time, the control unit 100 will stop the switching of the switch module SW.

Figure 4A:
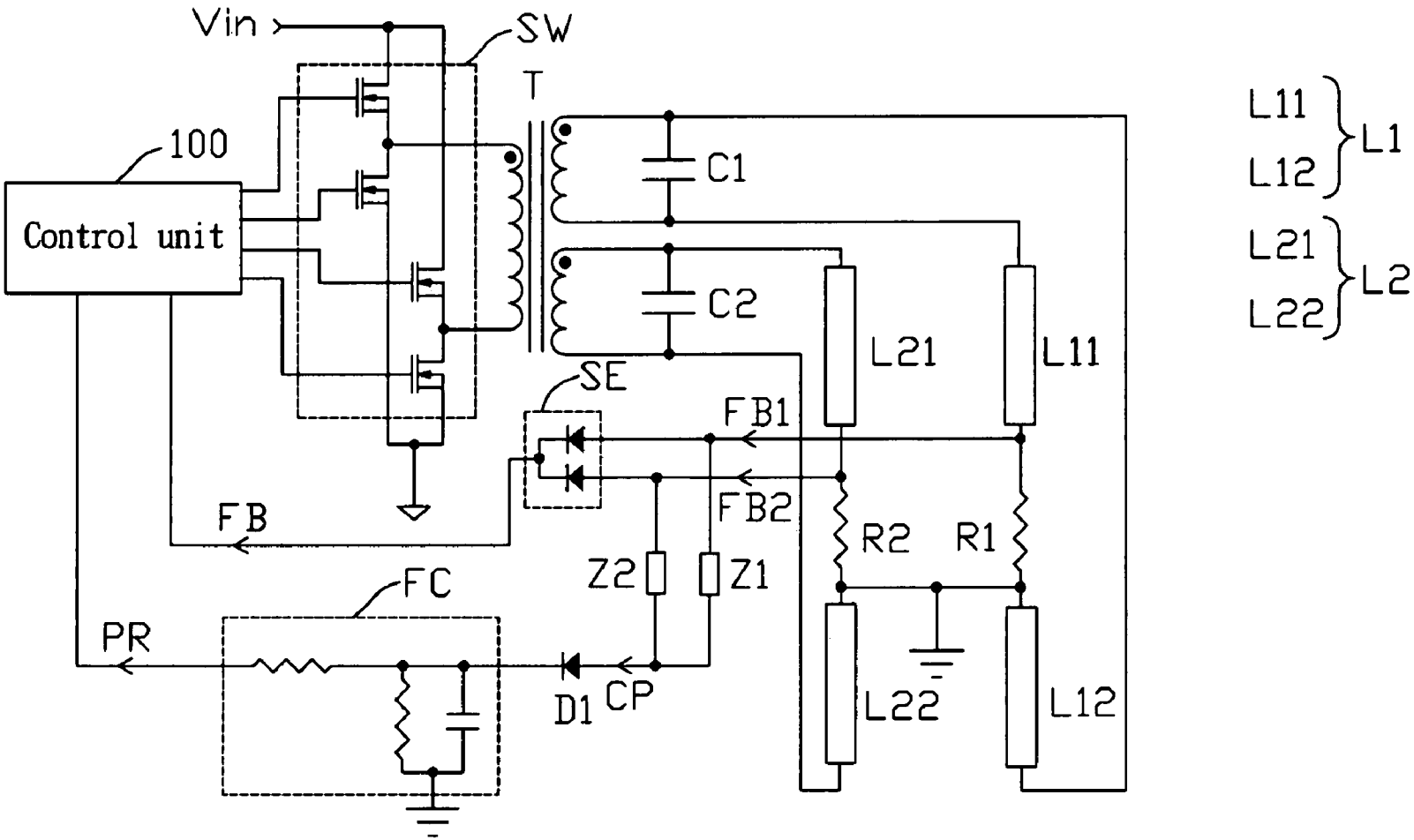
FIG. 4A is a circuit diagram of a multi-lamp driver circuit in accordance with a third preferred embodiment of the present invention.

With reference to FIG. 4A for a circuit diagram of a multi-lamp driver circuit in accordance with a third preferred embodiment of the present invention, the first fluorescent lamp module L1 includes a plurality of fluorescent lamps L11, L12, and the second fluorescent lamp module L2 includes a plurality of fluorescent lamps L21, L22. There are two windings at a secondary side of the transformer T coupled to the resonant capacitors C1, C2 respectively for converting electric power into a first AC signal and a second AC signal. One end of the first detecting resistor R1 and one end of the second detecting resistor R2 of the detection unit are coupled to a common ground. The other end of the first detecting resistor R1 is serially connected to the first fluorescent lamp module L1 for generating a first detection signal FB1, and the other end of the second detecting portion R2 is serially connected to the second fluorescent lamp module L2 for generating a second detection signal FB2. Because of the coupling among the first detecting resistor R1, the second detecting resistor R2, and the two secondary side windings, currents passing through the first detecting resistor R1 and the second detecting resistor R2 have opposite values. Therefore, the level of the protection feedback signal PR outputted by the protection unit approaches zero under normal operation condition. However, if any abnormality occurs in the circuit, the magnitude difference between the first detection signal FB1 and the second detection signal FB2 would be increased and/or the phase difference would be deviated away from the 180 degrees more seriously, and thus causing a level rising of the protection feedback signal PR. Similarly, if the level of the protection feedback signal PR is higher than a predetermined value, the control unit 100 will stop the switching of the switch module SW. In order to prevent misjudgments, the control unit 100 will stop the switching of the switch module SW if the level of the protection feedback signal PR is higher than the predetermined value and remained at such condition after a predetermined time.

Figure 4B:
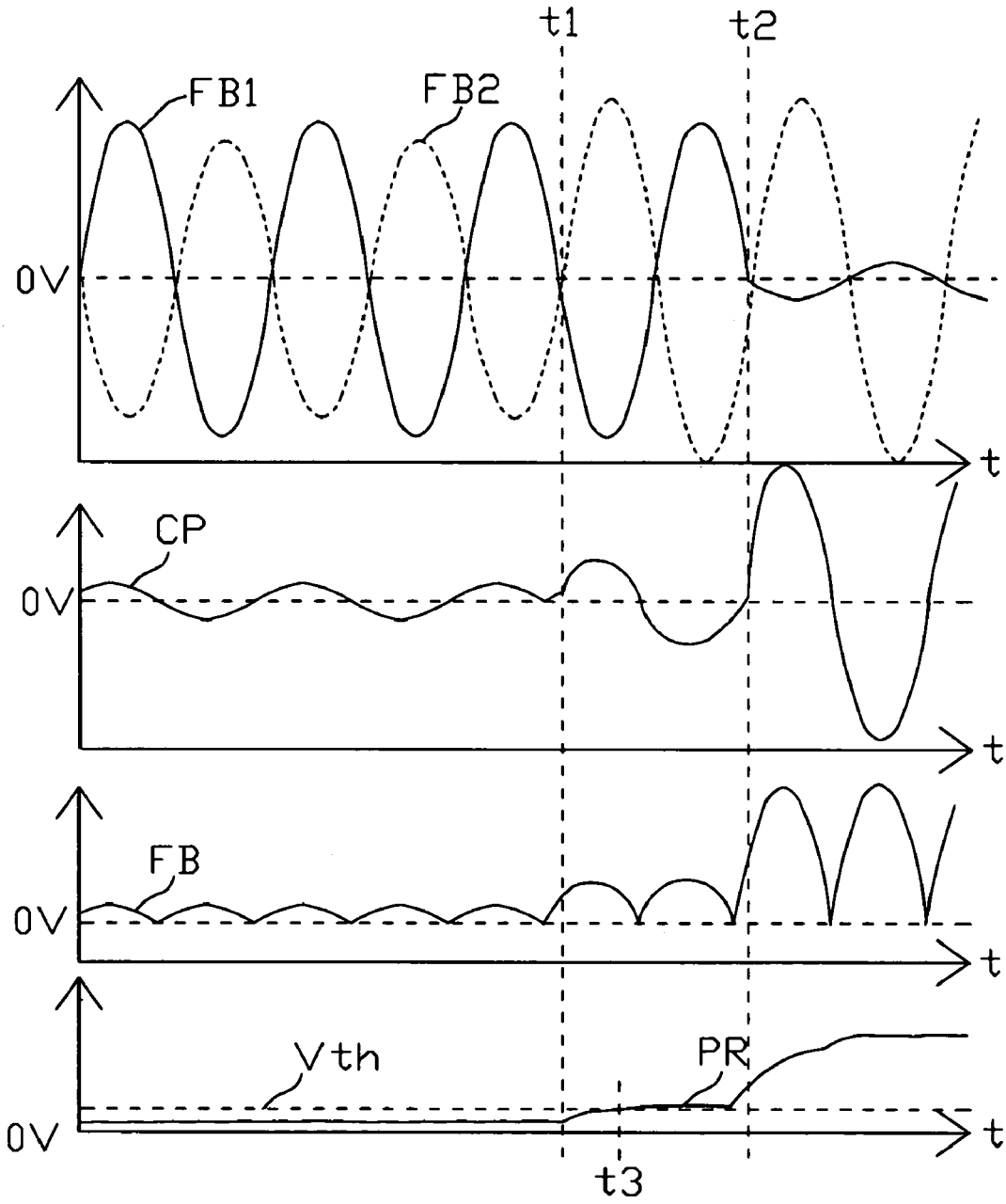
FIG. 4B is a schematic diagram showing the waveform of signals in the multi-lamp driver circuit of FIG. 4A.

FIG. 4B is a schematic diagram showing waveforms of the first detection signal FB1, the second detection signal FB2, the compensation signal CP, the select signal FB, and the protection feedback signal PR in the multi-lamp driver circuit of FIG. 4A. Under normal operation condition, there exists a slight impedance mismatch between the first fluorescent lamp module L1 and the second fluorescent lamp module L2. Thus, the amplitude of the first detection signal FB1 and the second detection signal FB2 are slightly different, the phase difference is approximately equal to 180 degrees, and the compensation signal CP would be oscillated around zero potential. At time point t1, an abnormality (such as a short circuit) of the second fluorescent lamp module L2 occurs and the current rises suddenly. Meanwhile, the amplitude difference between the first detection signal FB1 and the second detection signal FB2 increases, the phase difference is deviated from the 180 degrees, the amplitude of the compensation signal CP increases accordingly, and the voltage of the protection feedback signal PR rises gradually. At time point t3, the protection feedback signal PR is higher than a threshold voltage Vth, the control unit 100 begins its countdown to enter into a protection state to stop supplying electric power to the resonance module after a predetermined time. At time point t2, abnormality (such as an open circuit) occurs in the first fluorescent lamp module L1 and the current passing through the first fluorescent lamp module L1 drops suddenly. At this time, the amplitude difference between the first detection signal FB1 and the second detection signal FB2 is quite large, the amplitude of the compensation signal CP increases significantly, and the protection feedback signal PR rises rapidly. The protection feedback signal PR remains at a level higher than the threshold voltage Vth, and the control unit 100 keeps its countdown to enter into the protection state (not shown in the figure) after a predetermined time.

As shown in FIG. 4B, any abnormal circuit, regardless of open circuit or short circuit, will cause an increasing of amplitude difference between the first detection signal FB1 and the second detection signal FB2 and/or a signification deviation of the phase difference from the 180 degrees. Thereby, the protection feedback signal PR exceeds the predetermined threshold voltage Vth to enable the protection function of the control unit 100 and achieve the object of circuit protection.

Figure 5A:
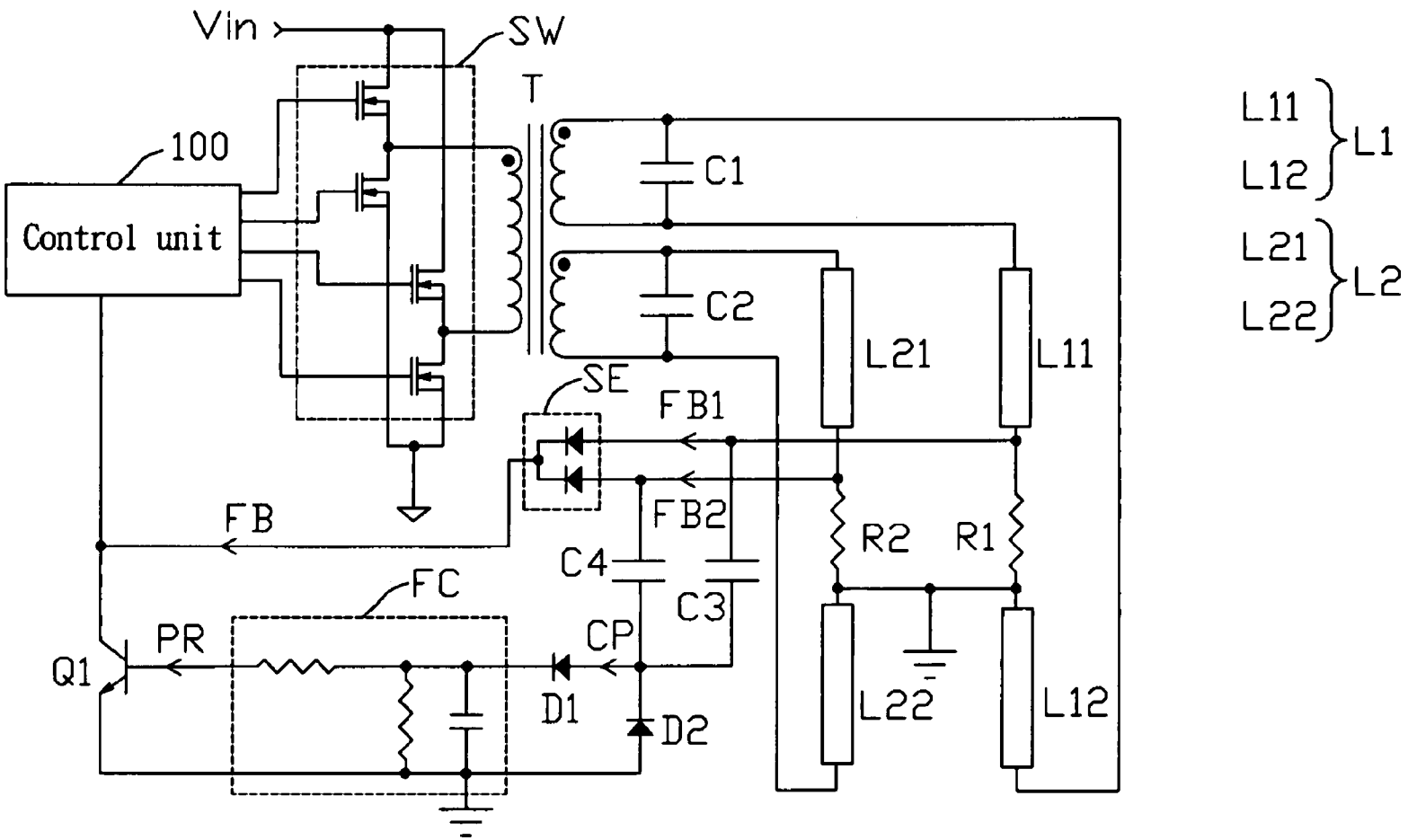
FIG. 5A is a circuit diagram of a multi-lamp driver circuit in accordance with a fourth preferred embodiment of the present invention.
Figure 5B:
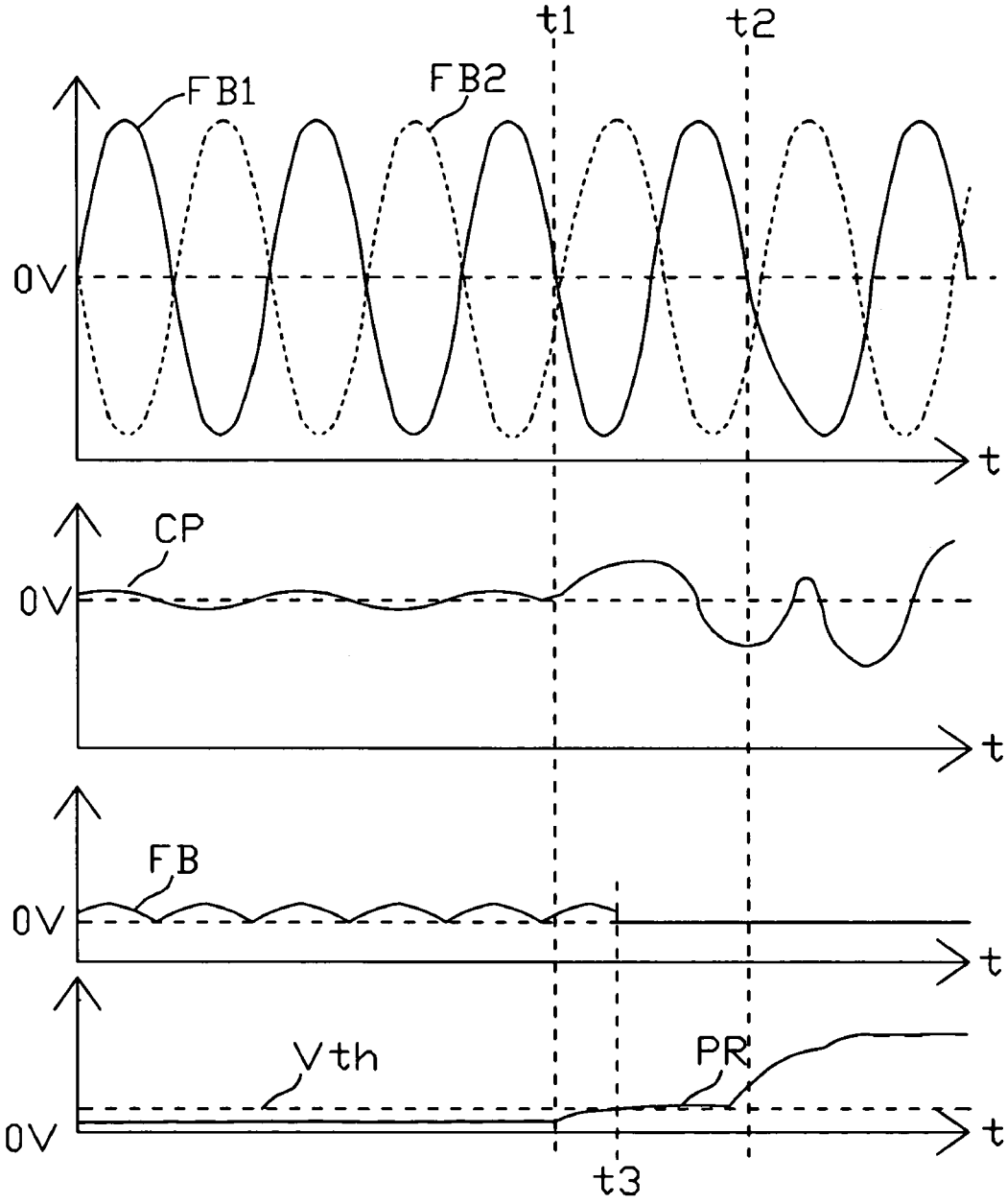
FIG. 5B is a schematic diagram showing the waveform of signals in the multi-lamp driver circuit of FIG. 5A.

With reference to FIG. 5A for a circuit diagram of a multi-lamp driver circuit in accordance with a fourth preferred embodiment of the present invention, the difference of this preferred embodiment from the embodiment as shown in FIG. 4A is that the compensating portion of the present embodiment adopts two compensation capacitors C3, C4 with one end thereof coupled to the first detecting resistor R1 and the second detecting resistor R2 of the detection unit respectively, and other ends thereof coupled with each other. The usage of capacitors as the compensating portion is capable to compensate impedance mismatch between the first fluorescent lamp module L1 and the second fluorescent lamp module L2 to equalize the current passing through the two fluorescent lamp modules L1 and L2. The protection unit further includes a control portion Q1 coupled to the selection unit SE. The control portion Q1 will pull the level of the select signal FB back to the level substantially equal to zero potential to have the select signal FB transferred into a protection state if the protection feedback signal PR is higher than a protection level. The control unit 100 simply requires a single pin to receive the select signal FB for determining whether to perform feedback control or circuit protection control according to the level of the select signal FB. FIG. 5B shows the waveforms of the first detection signal FB1, the second detection signal FB2, the compensation signal CP, the select signal FB, and the protection feedback signal PR of the multi-lamp driver circuit of FIG. 5A. As shown, a short circuit occurs in the second fluorescent lamp module L2 at time point t1. Because of the capacitors C3, C4, the magnitude of current passing through the first detecting portion R1 and the second detecting portion R2 is not changed significantly and the amplitudes of the first detection signal FB1 and the second detection signal FB2 remains close to each other. However, because the phase difference is deviated significantly from the 180 degrees, the amplitude of the compensation signal CP would be increased and the voltage of the protection feedback signal PR rises gradually. At time point t3, the level of the protection feedback signal PR is higher than the threshold voltage Vth, the select signal FB is compulsorily pulled back, and the control unit 100 will enter into a protection state to stop supplying electric power to the resonance module after a predetermined time. At time point t2, an abnormal open circuit occurs suddenly in the first fluorescent lamp module L1. Similarly, there is no significant change to the amplitude difference between the first detection signal FB1 and the second detection signal FB2, but the phase difference is deviated away from the 180 degrees more seriously, so that the amplitude of the compensation signal CP increases significantly and the protection feedback signal PR rises rapidly. The protection feedback signal PR remains at a level higher than the threshold voltage Vth, and the control unit 100 keeps its countdown to enter into a protection state (not shown in the figure) after a predetermined time.

In the fluorescent lamp driver circuit in accordance with the foregoing preferred embodiments of the present invention, the control unit can achieve the feedback control of multi-lamp and circuit protection by the detection signal selected by the selection unit and the protection feedback signal. The control unit can even adjust and control the level of the selected detection signal according to the state of the protection feedback signal. The control unit of the present invention does not have to increase the number of feedback and circuit protection pins as the number of fluorescent lamps increases, but simply have to use two pins or even one pin to achieve the feedback control and circuit protection functions of multi-lamp. Thus, the corresponding circuit design can be simplified, and the number of required electronic components can be reduced significantly.

Although the present invention has been described with reference to the preferred embodiments thereof, it shall be understood that the present invention is not limited to the details thereof. Various substitutions and modifications have been suggested in the foregoing description, and others will occur to those of ordinary skill in the art. Therefore, all such substitutions and modifications are intended to be embraced within the scope of the present invention as defined in the appended claims.

What is claimed is:

1. A fluorescent lamp driver circuit, comprising:

a switch module, coupled to a DC input voltage, for controlling the magnitude of an output electric power according to a plurality of control signals;

a resonance module, coupled to the switch module, for converting the output electric power into a first AC signal and a second AC signal, and a phase difference between the first AC signal and the second AC signal falling within a predetermined range from 180 degrees;

a first fluorescent lamp module, coupled to the resonance module for receiving the first AC signal;

a second fluorescent lamp module, coupled to the resonance module for receiving the second AC signal;

a detection unit, including a first detecting portion and a second detecting portion, one end of the first detecting portion and one end of the second detecting portion being coupled to a common ground, the other end of the first detecting portion being serially connected to the first fluorescent lamp module for generating a first detection signal, and the other end of the second detecting portion being serially connected to the second fluorescent lamp module for generating a second detection signal;

a selection unit, for receiving the first detection signal and the second detection signal, and selectively outputting one of the first detection signal and the second detection signal as a select signal;

a protection unit, for receiving the first detection signal and the second detection signal, and outputting a protection feedback signal; and a control unit, coupled to the selection unit and the protection unit, for generating the control signals to control the switching of the switch module according to the select signal, and stopping the switching of the switch module if a level of the protection feedback signal being higher than a predetermined value.

2. The fluorescent lamp driver circuit of claim 1, wherein the protection unit includes a compensating portion having the first detection signal and the second detection signal compensated with each other to generate a compensation signal.

3. The fluorescent lamp driver circuit of claim 2, wherein the protection unit includes a filter portion for filtering the compensation signal to generate the protection feedback signal.

4. The fluorescent lamp driver circuit of claim 2, wherein the compensating portion includes at least two capacitors, for compensating currents of the first fluorescent lamp module and the second fluorescent lamp module.

5. A fluorescent lamp driver circuit, comprising:

a switch module, coupled to a DC input voltage, for controlling the magnitude of an output electric power according to a plurality of control signals;

a resonance module, coupled to the switch module, for converting the output electric power into a first AC signal and a second AC signal, and a phase difference between the first AC signal and the second AC signal falling within a predetermined range from 180 degrees;

a first fluorescent lamp module, coupled to the resonance module for receiving the first AC signal;

a second fluorescent lamp module, coupled to the resonance module for receiving the second AC signal;

a detection unit, including a first detecting portion and a second detecting portion, one end of the first detecting portion and one end of the second detecting portion respectively being coupled to a common ground, the other end of the first detecting portion being serially connected to the first fluorescent lamp module for generating a first detection signal, and the other end of the second detecting portion being serially connected to the second fluorescent lamp module for generating a second detection signal;

a selection unit, coupled to the detection unit for receiving the first detection signal and the second detection signal, and selectively outputting one of the first detection signal and the second detection signal as a select signal;

a protection unit, coupled to the selection unit and the detection unit, for determining whether to transfer the select signal into a protection state or not according to the first detection signal and the second detection signal; and a control unit, coupled to the selection unit and the protection unit, for generating the control signals to control the switching of the switch module according to the select signal, and stopping the switching of the switch module after the select signal being transferred into the protection state.

6. The fluorescent lamp driver circuit of claim 5, wherein the control unit stops the switching of the switch module after the select signal being transferred into the protection state and remains in the protection state for a predetermined time.

7. The fluorescent lamp driver circuit of claim 6, wherein the protection unit includes a compensating portion having the first detection signal and the second detection signal compensated with each other to generate a compensation signal.

8. The fluorescent lamp driver circuit of claim 7, wherein the protection unit includes a filter portion for filtering the compensation signal to generate the protection feedback signal.

9. The fluorescent lamp driver circuit of claim 7, wherein the compensating portion includes at least two capacitors for compensating currents of the first fluorescent lamp module and the second fluorescent lamp module.

10. The fluorescent lamp driver circuit of claim 7, wherein the protection unit includes a control portion coupled to the selection unit, for transferring the select signal into the protection state if a level of the protection feedback signal is higher than a protection level.

11. A fluorescent lamp driver circuit, comprising:

a switch module, coupled to a DC input voltage, for controlling the magnitude of an output electric power according to a plurality of control signals;

a resonance module, having a primary side coupled to the switch module and a secondary side, for converting the output electric power into an AC signal and outputting the AC signal from the secondary side;

a first fluorescent lamp module, coupled to the secondary side of the resonance module;

a second fluorescent lamp module, coupled to the secondary side of the resonance module;

a detection unit, including a first detecting portion and a second detecting portion, one end of the first detecting portion and one end of the second detecting portion being coupled to a common ground, the other end of the first detecting portion being serially connected to the first fluorescent lamp module for generating a first detection signal, the other end of the second detecting portion being serially connected to the second fluorescent lamp module for generating a second detection signal, and a phase difference between the first detection signal and the second detection signal falling within a predetermined range from 180 degrees;

a selection unit, coupled to the detection unit, for receiving the first detection signal and the second detection signal, and selectively outputting one of the first detection signal and the second detection signal as a select signal;

a protection unit, for receiving the first detection signal and the second detection signal, and outputting a protection feedback signal; and a control unit, coupled to the protection unit, outputting the control signals if the protection feedback signal is in a first state, and stopping the switching of the switch module if the protection feedback signal is in a second state;

wherein the protection unit is configured to cause the select signal to enter into a protection state if the protection feedback signal is in the second state, and stop the switch module from switching when the control unit detects the select signal has been entering into the protection state.

12. The fluorescent lamp driver circuit of claim 11, wherein the resonance module includes a transformer having a first secondary winding and a second secondary winding coupled to the first fluorescent lamp module and the second fluorescent lamp module respectively.

13. The fluorescent lamp driver circuit of claim 12, wherein the control unit stops the switch module from switching after the protection feedback signal is at the second state and remains in the second state for a predetermined time.

14. The fluorescent lamp driver circuit of claim 12, wherein the protection unit includes a compensating portion having the first detection signal and the second detection signal compensated with each other to generate a compensation signal.

15. The fluorescent lamp driver circuit of claim 14, wherein the protection unit includes a filter portion for filtering the compensation signal to generate the protection feedback signal.

16. The fluorescent lamp driver circuit of claim 14, wherein the compensating portion includes at least two capacitors for compensating currents of the first fluorescent lamp module and the second fluorescent lamp module.

17. The fluorescent lamp driver circuit of claim 11, wherein the resonance module includes a transformer having a secondary winding, and the first fluorescent lamp module and the second fluorescent lamp module are coupled in parallel to the secondary winding.

18. The fluorescent lamp driver circuit of claim 17, wherein the control unit is configured to stop the switch module from switching after the protection feedback signal is at the second state and remains in the second state for a predetermined time.

19. The fluorescent lamp driver circuit of claim 17, wherein the protection unit includes a compensating portion having the first detection signal and the second detection signal compensated with each other to generate a compensation signal.

20. The fluorescent lamp driver circuit of claim 19, wherein the protection unit includes a filter portion for filtering the compensation signal to generate the protection feedback signal.

21. The fluorescent lamp driver circuit of claim 19, wherein the compensating portion includes at least two capacitors for compensating currents of the first fluorescent lamp module and the second fluorescent lamp module.

* * * * *